US010164370B2

(12) United States Patent
Ono

(10) Patent No.: US 10,164,370 B2
(45) Date of Patent: Dec. 25, 2018

(54) ELECTRICAL CONNECTOR

(71) Applicant: SMK Corporation, Tokyo (JP)

(72) Inventor: Naoyuki Ono, Chiba (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/826,731

(22) Filed: Nov. 30, 2017

(65) Prior Publication Data

US 2018/0294599 A1 Oct. 11, 2018

(30) Foreign Application Priority Data

Apr. 7, 2017 (JP) ..... 2017-76956

(51) Int. Cl.
*H01R 13/52* (2006.01)
*H01R 13/504* (2006.01)
*H01R 13/405* (2006.01)

(52) U.S. Cl.
CPC ..... *H01R 13/5202* (2013.01); *H01R 13/405* (2013.01); *H01R 13/5045* (2013.01)

(58) Field of Classification Search
CPC ..... H01R 13/5202; H01R 13/405; H01R 13/5045
USPC ..... 439/587
See application file for complete search history.

(56) References Cited

U.S. PATENT DOCUMENTS 4,714,801 A * 12/1987 Koblitz ..... H01R 13/5216 174/84 C
5,004,869 A * 4/1991 Koblitz ..... H01R 4/2495 174/84 C
7,568,932 B2 * 8/2009 O'Connor ..... H01R 4/029 439/271
7,828,591 B2 * 11/2010 Matsuoka ..... H01R 4/183 439/559
9,685,728 B2 * 6/2017 Yao ..... H01R 13/521
9,793,644 B2 * 10/2017 Fujii ..... H01R 13/5202
2017/0054246 A1 * 2/2017 Yao ..... H01R 13/521
2017/0271809 A1 * 9/2017 Fujii ..... H01R 13/6581
2017/0302037 A1 * 10/2017 Yao ..... H01R 24/60
2017/0365961 A1 * 12/2017 Zhao ..... H01R 13/5202
2017/0373438 A1 * 12/2017 Qiu ..... H01R 13/6581
2018/0006401 A1 * 1/2018 Ishibashi ..... H01R 13/6315
2018/0131145 A1 * 5/2018 Zhao ..... H01R 24/60
2018/0138642 A1 * 5/2018 Kong ..... H01R 13/658

OTHER PUBLICATIONS

Office Action issued for counterpart Japanese Application 2017-076956, issued by the Japan Patent Office dated Jun. 27, 2017.

* cited by examiner

*Primary Examiner* — Alexander Giman

(57) ABSTRACT

An electrical connector is provided to have a watertight function and a portion on its rear side downsized. The electrical connector includes an insulating housing, conductive contacts held by the housing, and a shell for containing the housing. The conductive contacts each include a connection portion exposed on the front side of the housing to connect to a mating contact of a mating connector, and a terminal portion protruding rearward from the housing. The shell includes a front shell member and a rear shell member provided in the rear of the front shell member. The front shell member has a fitting portion open to the front into which the mating connector is insertable. The rear shell member has a smaller diameter than the front shell member. A space between the housing and a constriction portion is tightly sealed.

5 Claims, 8 Drawing Sheets

ELECTRICAL CONNECTOR

CROSS REFERENCE TO RELATED APPLICATION

The contents of the following Japanese patent application are incorporated herein by reference, Japanese Patent Application No. 2017-76956 filed on Apr. 7, 2017.

FIELD

The present invention relates to an electrical connector having a watertight function.

BACKGROUND

Conventionally, electrical connectors attached to devices such as electronic devices have been required to have a watertight function in order to make the inside of the devices watertight from the outside. Such an electrical connector has to prevent liquid from getting into a casing of the device through a fitting portion that is exposed to an outer surface of the casing of the device to connect to a mating connector.

Patent Literature 1 discloses an electrical connector having a watertight function. The electrical connector includes a cylindrical shell and an insulating support portion that holds contacts and is contained in the shell. A ring-shaped sealing member tightly seals a gap between the shell and the support portion. In the electrical connector according to Patent Literature 1, a recessed portion is provided in the circumference of the support portion, and the sealing member is fitted into the recessed portion.

CITATION LIST

Patent Literature

Patent Literature 1: Japanese Patent Application Laid-Open No. 2017-033671

SUMMARY

Technical Problem

However, Patent Literature 1 requires a space between the shell and the contacts to dispose a housing and the sealing member therein in order to hold the sealing member within the recessed portion of the circumference of the support portion, and accordingly prevents downsizing. In particular, the devices such as the electronic devices are required to be small and slim in recent years. Downsizing an electrical connector on its rear side, in which a terminal portion is disposed to connect to a conductive portion of a substrate in the casing of the device, is effective at making the device small and slim to which the electrical connector is attached.

An object of the present invention is to provide an electrical connector that has a watertight function and a reduced size on its rear side to which terminal portions of contacts are disposed.

Solution to Problem

An electrical connector according to an aspect of the present invention includes: an insulating holding member; a conductive contact held by the holding member, the conductive contact including a connection portion exposed on the front side of the holding member to connect to a mating contact of a mating connector and a terminal portion protruding from the holding member; and a cylindrical shell configured to contain the holding member, the cylindrical shell including a large diameter portion and a small diameter portion, the large diameter portion having a fitting portion open to the front into which the mating connector is insertable, the small diameter portion being provided in the rear of the large diameter portion so as to protrude the terminal portion therefrom, the small diameter portion having a smaller diameter than the large diameter portion. A space between the holding member and the small diameter portion is tightly sealed.

The diameter of the small diameter portion, which is provided in the rear of the large diameter portion of the shell, is reduced, relative to the large diameter portion, to downsize the electrical connector on its rear side, while a space between the small diameter portion of the shell and the holding member is tightly sealed to provide a watertight function.

According to the aspect of the present invention, it is possible to downsize the electrical connector on its rear side from which the terminal portion of the contact protrudes, as well as to provide a watertight function.

DESCRIPTION OF EMBODIMENTS

Figure 1:
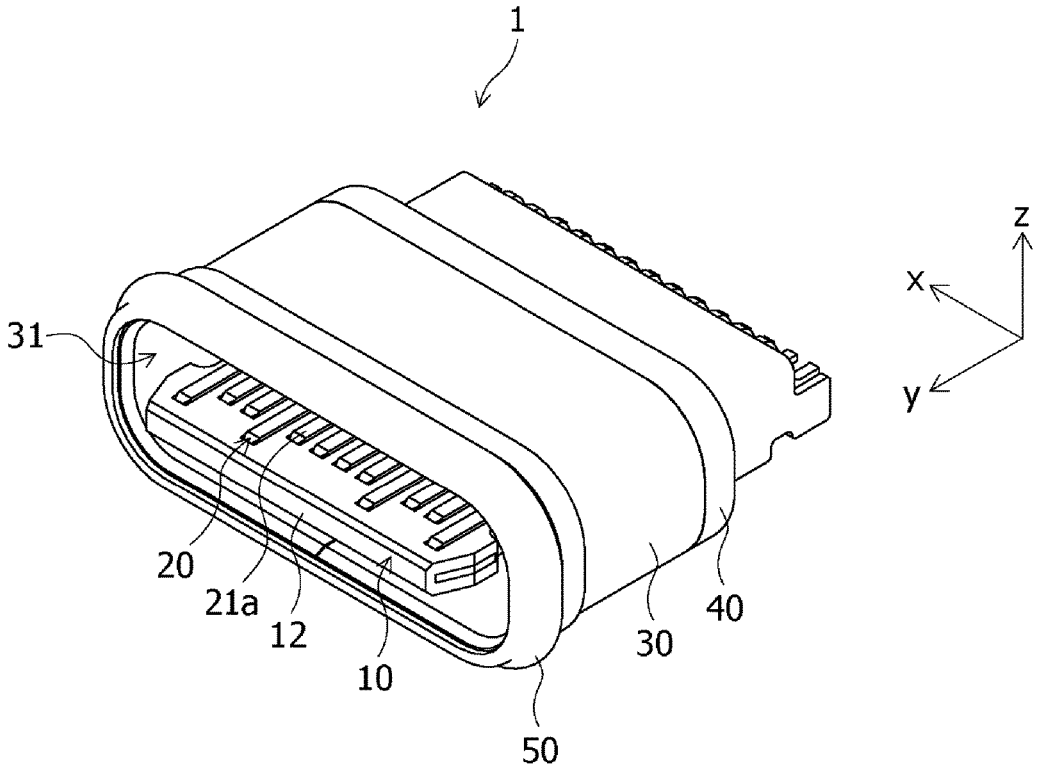
FIG. 1 is a perspective view of an electrical connector according to a first embodiment of the present invention.
Figure 2:
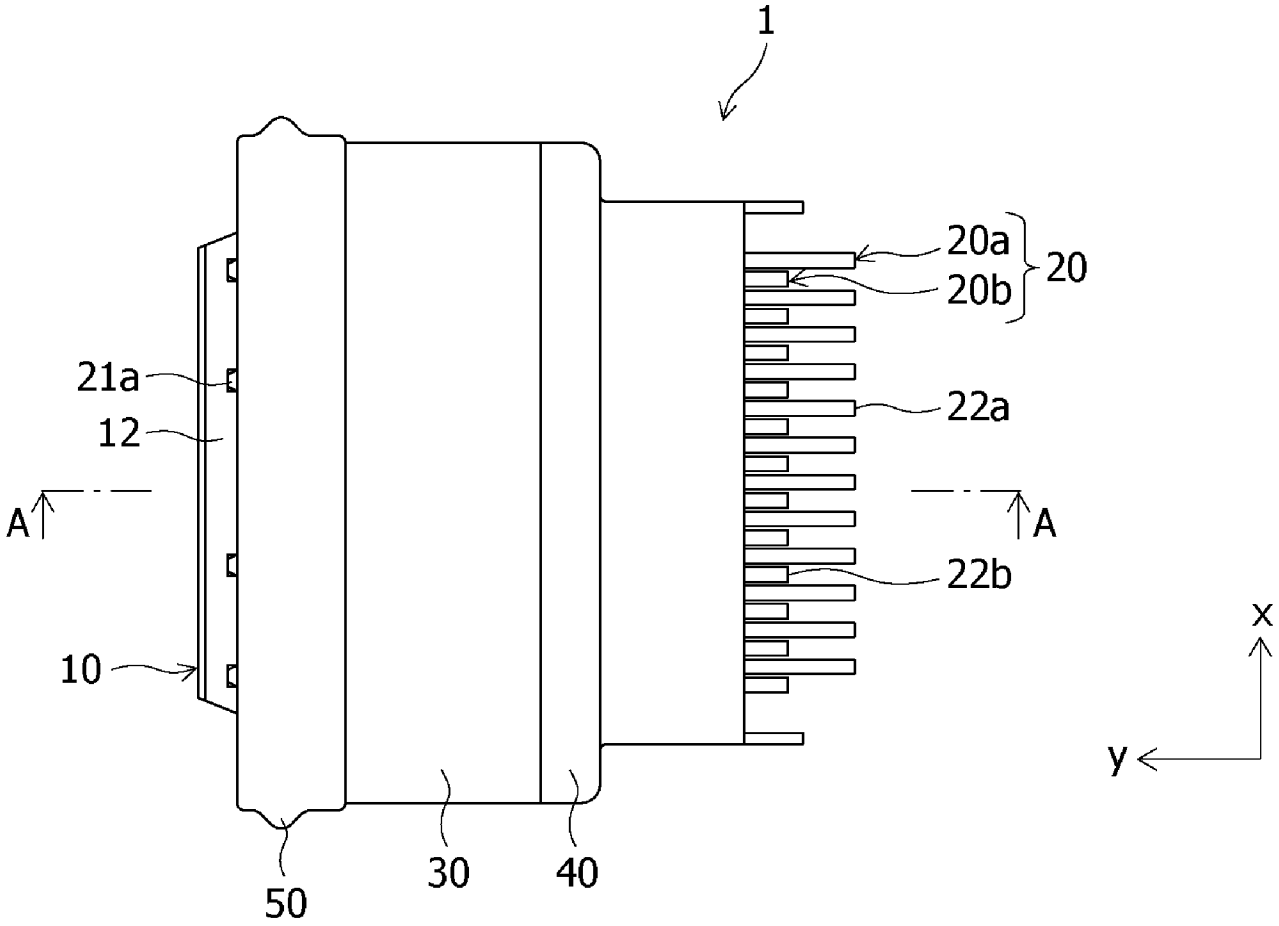
FIG. 2 is a plan view of the electrical connector according to the first embodiment of the present invention.
Figure 3:
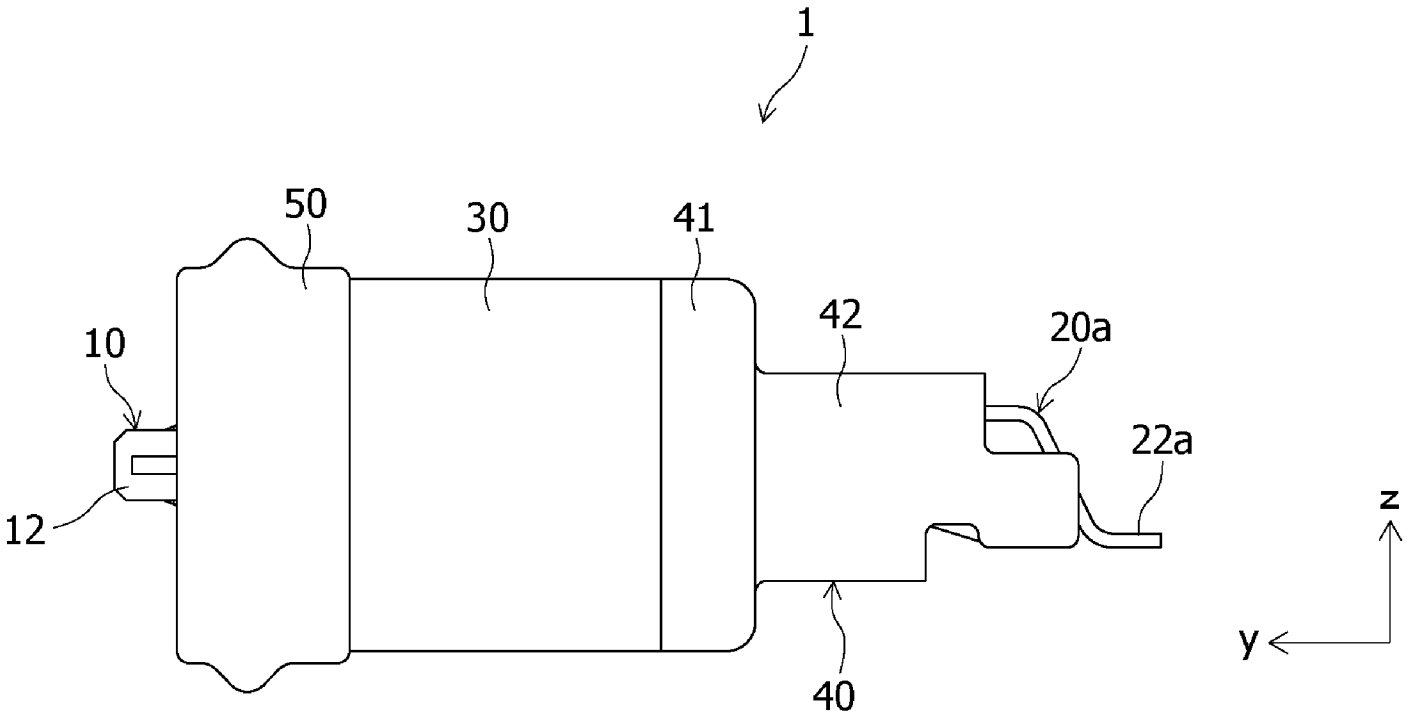
FIG. 3 is a side view of the electrical connector according to the first embodiment of the present invention.

An electrical connector according to an embodiment of the present invention will be described below in detail with appropriate reference to the drawings. In the drawings, an x axis, a y axis, and a z axis constitute a three-axis orthogonal coordinate system. In the following description, a positive direction of the y-axis will be referred to as a front direction, a negative direction of the y-axis as a rear direction, the direction of the x-axis as a horizontal direction, a positive direction of the z-axis as an upward direction, and a negative direction of the z-axis as a downward direction.

First Embodiment

<Configuration of Electrical Connector>

A configuration of an electrical connector 1 according to a first embodiment of the present invention will be described below in detail with reference to FIGS. 1 to 4.

The electrical connector 1 according to this embodiment has a housing 10, contacts 20, a front shell member 30, a rear shell member 40, an external watertight member 50, and a shielding plate 60.

The housing 10, which is made of an insulating material, is a holding member for holding the contacts 20. The housing 10 contains a silane coupling agent in a portion that is in close contact with the contacts 20 along outer peripheral surfaces of the contacts 20. The housing 10 does not contain the silane coupling agent at its rear end from which the contacts 20 protrude rearward. Since the silane coupling agent has a reaction group chemically bonding to an inorganic material and a reaction group chemically bonding to an organic material, the silane coupling agent has the property capable of bonding an organic material and an inorganic material.

The housing 10 has a main body portion 11 and a plate-like portion 12.

Figure 4:
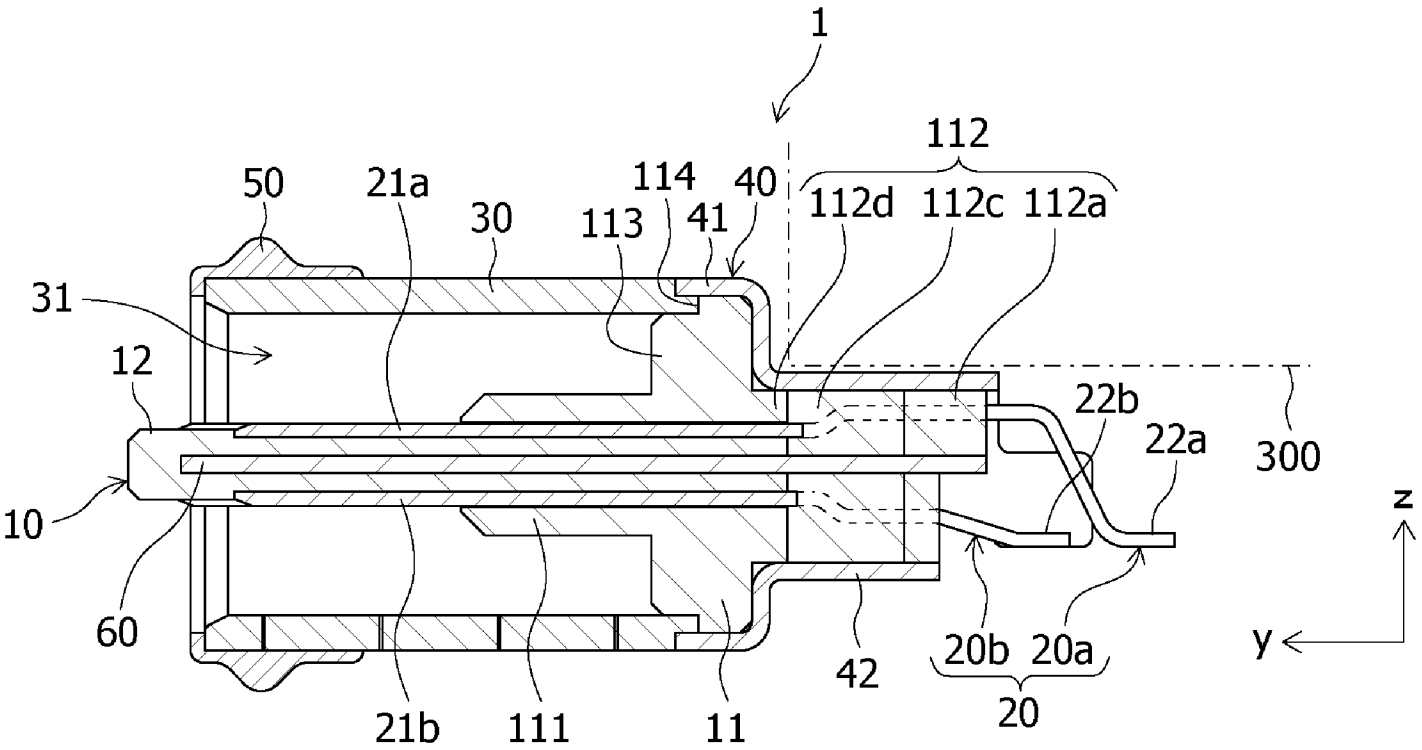
FIG. 4 is a cross-sectional view taken along line A-A in FIG. 2.

The main body portion 11 for holding the contacts 20 has, as shown in FIG. 4, a front protruding portion 111 protruding frontward, a rear protruding portion 112 protruding rearward, and an outward protruding portion 113 protruding outward relative to the front protruding portion 111 and the rear protruding portion 112 between the front protruding portion 111 and the rear protruding portion 112. The outward protruding portion 113 has a step portion 114.

The rear protruding portion 112 is constituted of a front end portion 112*d* that protrudes rearward from a rear end of the outward protruding portion 113 and contains no silane coupling agent, a rear end portion 112*a* that is provided at the rear end of the housing 10 and contains no silane coupling agent, and a watertight resin portion 112*c* that is provided between the front end portion 112*d* and the rear end portion 112*a* and contains the silane coupling agent.

The watertight resin portion 112*c* is in close contact with the rear shell member 40 along a circumferential direction of an inner peripheral surface of the rear shell member 40, as well as being in close contact with the contacts 20 along the outer peripheral surfaces of the contacts 20. The watertight resin portion 112*c* is made of a resin of a different type from the resin of the plate-like portion 12, the front protruding portion 111, the rear end portion 112*a*, the front end portion 112*d*, and the outward protruding portion 113. The resin of the watertight resin portion 112*c* melts at a lower temperature than the resin of the plate-like portion 12, the front protruding portion 111, the rear end portion 112*a*, the front end portion 112*d*, and the outward protruding portion 113.

Note that FIG. 4 shows clear boundaries between the front end portion 112*d*, the rear end portion 112*a*, and the watertight resin portion 112*c*, for the sake of explanation, but the boundaries are unclear in fact, because the front end portion 112*d* and the watertight resin portion 112*c* are melted and bonded at their contact portions in a manufacturing process described later, and the rear end portion 112*a* and the watertight resin portion 112*c* are melted and bonded at their contact portions in the manufacturing process described later.

The plate-shaped plate-like portion 12 protrudes frontward relative to the main body portion 11, and protrudes frontward at its front end relative to the front shell member 30.

The contacts 20 are made of a conductive material, and held by the housing 10. The contacts 20 include first contacts 20*a* and second contacts 20*b* disposed below the first contacts 20*a*. The first contacts 20*a* and the second contacts 20*b* are insulated from each other by the housing 10.

Each first contact 20*a* includes a connection portion 21*a* that is exposed on the front side of the housing 10 on a top surface of the plate-like portion 12 to connect to a mating contact of a not-shown mating connector, and a terminal portion 22*a* that protrudes rearward relative to the housing 10 and is soldered to a conductive portion of a not-shown substrate. The first contact 20*a* is embedded in the front protruding portion 111, the rear protruding portion 112, and the outward protruding portion 113 at a portion between the connection portion 21*a* and the terminal portion 22*a*. The first contact 20*a* is in close contact with the watertight resin portion 112*c* along its outer peripheral surface. The first contact 20*a* is bent in the left, right, and upward directions in shape at a portion being in close contact with the watertight resin portion 112*c*.

Each second contact 20*b* includes a connection portion 21*b* that is exposed on the front side of the housing 10 on a bottom surface of the plate-like portion 12 to connect to the mating contact of the not-shown mating connector, and a terminal portion 22*b* that protrudes rearward relative to the housing 10 and is soldered to the not-shown substrate. The second contact 20*b* is embedded in the front protruding portion 111, the rear protruding portion 112, and the outward protruding portion 113 at a portion between the connection portion 21*b* and the terminal portion 22*b*. The second contact 20*b* is in close contact with the watertight resin portion 112*c* along its outer peripheral surface. The second contact 20*b* is bent in the left, right, and downward directions in shape at a portion being in close contact with the watertight resin portion 112*c*. Bottom ends of the terminal portions 22*a* and bottom ends of the terminal portions 22*b* are flush with one another in the vertical direction.

The front shell member 30 is made of a conductive material or an insulating material, and is in the shape of a cylinder penetrating in the front and rear directions. The front shell member 30 has a fitting portion 31 into which the not-shown mating connector can be fitted from the front. The fitting portion 31 is required to have a predetermined inner diameter in conformity with standards and the like. In the fitting portion 31, the plate-like portion 12 and the front protruding portion 111 are disposed. The front shell member 30 is in contact with the step portion 114 at its rear end, and is held on the front side of the outward protruding portion 113.

The rear shell member 40 is made of a conductive material or an insulating material, and is in the shape of a cylinder penetrating in the front and rear directions. The rear shell member 40 includes a diameter enlarging portion 41 held on the rear side of the outward protruding portion 113, and a constriction portion 42 that is continuously formed in the rear of the diameter enlarging portion 41 and has a smaller diameter than the diameter enlarging portion 41, so that the rear shell member 40 is narrowed rearward in shape. The outer diameter of the diameter enlarging portion 41 is approximately the same as the outer diameter of the front shell member 30. The constriction portion 42, which constitutes a small diameter portion, is in close contact with the watertight resin portion 112*c* along a circumferential direction of an inner peripheral surface. The front shell member 30 and the diameter enlarging portion 41 constitute a large diameter portion.

The external watertight member 50 is formed of an elastic and insulating material in a ring shape. The external watertight member 50 is provided at a front end of the front shell member 30.

The shielding plate 60 is made of a conductive material in a plate shape. The shielding plate 60 is embedded in the housing 10. The shielding plate 60 is provided between the first contacts 20*a* and the second contacts 20*b* so as to be insulated from the first contacts 20*a* and the second contacts 20*b*.

When the electrical connector 1 having the above-described configuration is attached to a casing of a not-shown electronic device, as shown in FIG. 4, another component 300 such as an LCD can be disposed above the constriction portion 42, as well as below or to the side of the constriction portion 42, because the constriction portion 42 has the smaller outer diameter than the front shell member 30 and the diameter enlarging portion 41.

<Method for Manufacturing Electrical Connector>

A method for manufacturing the electrical connector 1 according to the first embodiment of the present invention will be described below in detail with reference to FIGS. 1 to 6.

Figure 5:
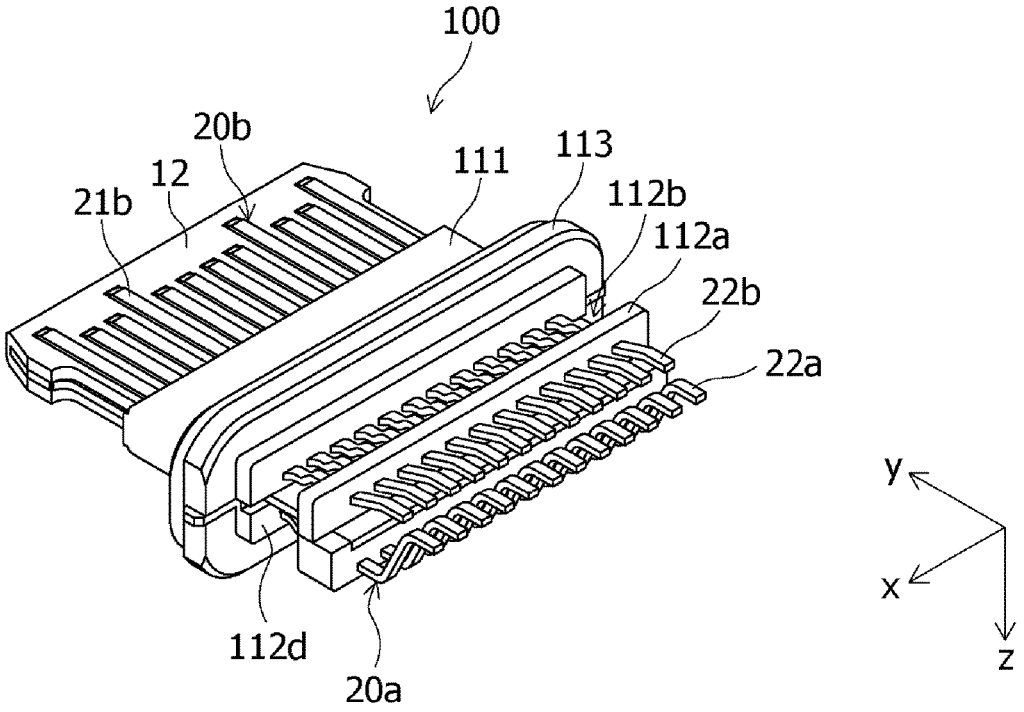
FIG. 5 is a perspective view of a primary molded article that constitutes the electrical connector according to the first embodiment of the present invention.

First, the contacts 20 and the shielding plate 60 formed in advance are set in a not-shown mold, and a resin that contains no silane coupling agent and is melted at a predetermine temperature is injected into and cured in the mold, to form a primary molded article 100 shown in FIG. 5 by integral molding. The primary molded article 100 has the plate-like portion 12, the contacts 20, the front protruding portion 111, the outward protruding portion 113, the front end portion 112*d*, the rear end portion 112*a*, and the shielding plate 60. The predetermined melting temperature for forming the primary molded article 100 is, for example, 300° C.

In the primary molded article 100, a space 112*b* is formed between the front end portion 112*d* and the rear end portion 112*a*, and the front end portion 112*d* and the rear end portion 112*a* are opposed to each other. In the space 112*b*, part of the first contacts 20*a* and part of the second contacts 20*b* are exposed to outside.

Figure 6:
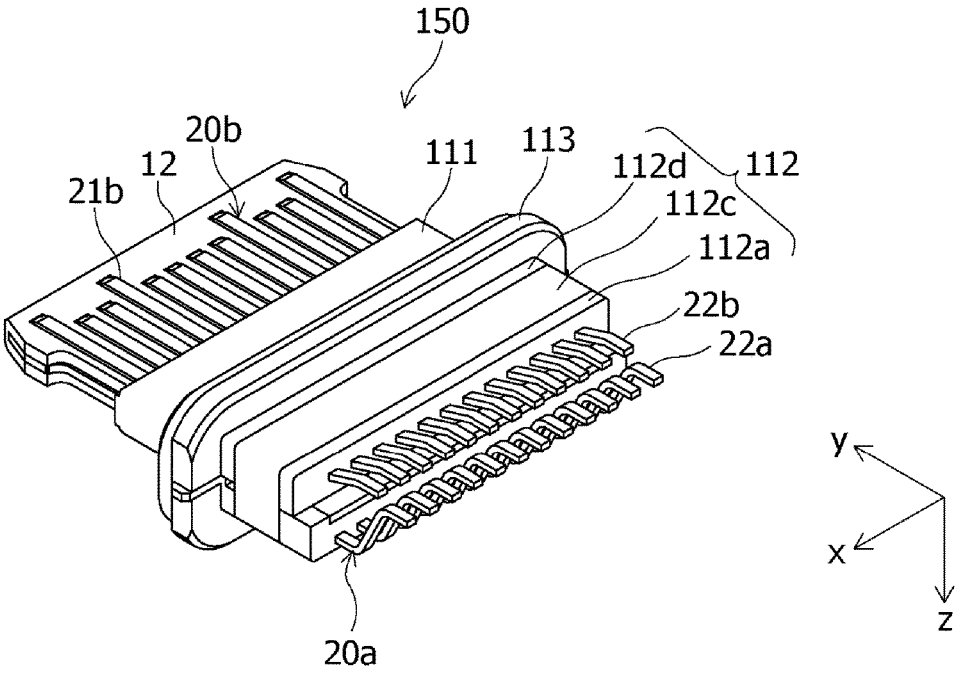
FIG. 6 is a perspective view of a secondary molded article that constitutes the electrical connector according to the first embodiment of the present invention.

Next, the primary molded article 100 is set in a not-shown mold, and a resin that contains a silane coupling agent is injected into and cured in the space 112*b* at a predetermined temperature, to form a secondary molded article 150 shown in FIG. 6 by integral molding. The secondary molded article 150 has the primary molded article 100 and the watertight resin portion 112*c*. In other words, in the secondary molded article 150, the watertight resin portion 112*c* is added to the primary molded article 100.

The resin poured into the space 112*b* is the resin of a different type from the resin of the plate-like portion 12, the front protruding portion 111, the rear end portion 112*a*, the front end portion 112*d*, and the outward protruding portion 113 of the primary molded article 100. The resin poured into the space 112*b* melts at a lower temperature than the resin of the plate-like portion 12, the front protruding portion 111, the rear end portion 112*a*, the front end portion 112*d*, and the outward protruding portion 113 of the primary molded article 100, and is a thermoplastic resin or the like. In other words, the melting point of the resin for forming the watertight resin portion 112*c* of the secondary molded article 150 is lower than that of the resin for forming the primary molded article 100. Therefore, the melting temperature of the resin for forming the watertight resin portion 112*c* of the secondary molded article 150 is set lower than the melting temperature of the resin for forming the primary molded article 100, in order to prevent the plate-like portion 12, the front protruding portion 111, the rear end portion 112*a*, the front end portion 112*d*, and the outward protruding portion 113 from melting again. The melting temperature of the resin for forming the watertight resin portion 112*c* of the secondary molded article 150 is, for example, 150° C.

As described above, since the melting temperature of the resin for forming the watertight resin portion 112*c* of the secondary molded article 150 is set at a value that does not melt the plate-like portion 12, the front protruding portion 111, the rear end portion 112*a*, the front end portion 112*d*, and the outward protruding portion 113 again, the plate-like portion 12, the front protruding portion 111, the rear end portion 112*a*, the front end portion 112*d*, and the outward protruding portion 113 reliably hold the contacts 20, when forming the secondary molded article 150. In particular, since the rear end portion 112*a* reliably holds the contacts 20, the positions of the protruding terminal portions 22*a* and terminal portions 22*b* from the rear end portion 112*a* do not deviate when forming the secondary molded article 150, thus preventing poor connection of the terminal portions 22*a* and the terminal portions 22*b* to the conductive portion of the substrate.

Next, the secondary molded article 150 is covered with the front shell member 30 from the front, and is covered with the rear shell member 40 from the rear.

Next, the rear end of the front shell member 30 and the front end of the rear shell member 40 are welded to attach the front shell member 30 and the rear shell member 40 onto the secondary molded article 150.

Next, the external watertight member 50 is attached to the front end of the front shell member 30.

Next, the secondary molded article 150 to which the front shell member 30 and the rear shell member 40 are attached is heated at a temperature that is higher than the temperature for forming the watertight resin portion 112*c* and lower than the melting temperature of the resin for forming the primary molded article 100, in order to melt the watertight resin portion 112*c* again.

At this time, the watertight resin portion 112*c* is melted and bonded to an inner peripheral surface of the rear shell member 40 at a portion being in contact with the inner peripheral surface of the rear shell member 40, owing to the bonding action of the silane coupling agent contained in the watertight resin portion 112*c*. The watertight resin portion 112*c* is melted and bonded to the outer peripheral surfaces of the contacts 20 at a portion being in contact with the outer peripheral surfaces of the contacts 20 by the bonding action of the silane coupling agent contained in the watertight resin portion 112*c*. Therefore, the watertight resin portion 112*c* is put in close contact with the inner peripheral surface of the rear shell member 40 along the circumferential direction of the inner peripheral surface of the rear shell member 40, while putting in close contact with the outer peripheral surfaces of the contacts 20.

As described above, since the melting temperature of the resin for forming the watertight resin portion 112*c* is set at a value that does not melt the plate-like portion 12, the front protruding portion 111, the rear end portion 112*a*, the front end portion 112*d*, and the outward protruding portion 113 of the primary molded article 100 again, the plate-like portion 12, the front protruding portion 111, the rear end portion 112*a*, the front end portion 112*d*, and the outward protruding portion 113 reliably hold the contacts 20, when the watertight resin portion 112*c* is brought into close contact with the inner peripheral surface of the rear shell member 40. In particular, since the rear end portion 112*a* reliably holds the contacts 20, the positions of the protruding terminal portions 22*a* and terminal portions 22*b* from the rear end portion 112*a* do not deviate when the watertight resin portion 112*c* is brought into close contact with the inner peripheral surface of the rear shell member 40. Thus poor connection of the terminal portions 22*a* and the terminal portions 22*b* to the conductive portion of the substrate can be prevented.

Heating the secondary molded article 150 having the front shell member 30 and the rear shell member 40 attached thereto at a higher temperature than the temperature for forming the watertight resin portion 112*c* can melt at least the watertight resin portion 112*c* again and can bring the watertight resin portion 112*c* into firmly close contact with the rear end portion 112*a* and the front end portion 112*d*.

As described above, the watertight resin portion 112*c* has the adhesiveness to the contacts 20, which are made of metal, and the rear end portion 112*a* and the front end portion 112*d*, which are made of the resin.

Next, the secondary molded article 150 having the front shell member 30 and the rear shell member 40 attached thereto is cooled to complete the electrical connector 1.

In the electrical connector 1 manufactured by the above-described method, since the watertight resin portion 112*c* containing the silane coupling agent is in close contact with the inner peripheral surface of the rear shell member 40 so as to seal a gap between the watertight resin portion 112*c* and the rear shell member 40, a gap between the housing 10 and the rear shell member 40 is tightly sealed and the inside of the electronic device to which the electrical connector 1 is attached can be made watertight. In the electrical connector 1, since the watertight resin portion 112*c* containing the silane coupling agent is in close contact with the outer peripheral surfaces of the contacts 20 so as to seal a gap between the watertight resin portion 112*c* and each contact 20, a gap between the housing 10 and each contact 20 is tightly sealed and the interior of the electronic device to which the electrical connector 1 is attached can be made watertight. Furthermore, only providing the watertight resin portion 112*c* between the contacts 20 and the constriction portion 42 can make the electrical connector 1 have a watertight function, thus downsizing the electrical connector 1 on its rear side.

The method for manufacturing the electrical connector 1 is not limited to above. The electrical connector 1 may be manufactured by another manufacturing method described below.

More specifically, after the primary molded article 100 is formed by the above method, the primary molded article 100 is covered with the front shell member 30 from the front, and is covered with the rear shell member 40 from the rear.

Next, the rear end of the front shell member 30 and the front end of the rear shell member 40 are welded to attach the front shell member 30 and the rear shell member 40 onto the primary molded article 100.

Next, the external watertight member 50 is attached to the front end of the front shell member 30.

A molten thermoplastic resin containing a silane coupling agent is injected into and cured in the space 112*b* between the front end portion 112*d* and the rear end portion 112*a* of the primary molded article 100 from a not-shown through hole formed in advance in the rear shell member 40, to form the watertight resin portion 112*c*. Thus, the front shell member 30 and the rear shell member 40 are provided in the secondary molded article 150. Note that, the above-described through hole is sealed by curing of the molten resin containing the silane coupling agent.

Next, the secondary molded article 150 having the front shell member 30 and the rear shell member 40 is heated to melt the watertight resin portion 112*c*, and is thereafter cured. When melting the watertight resin portion 112*c*, the secondary molded article 150 is heated to a temperature at which none of the components constituting the housing 10, other than the watertight resin portion 112*c*, melts. Thus, while the watertight resin portion 112*c* is melted and in close contact with the inner peripheral surface of the rear shell member 40 along its circumferential direction owing to the bonding action of the silane coupling agent contained in the watertight resin portion 112*c*, the resin forming the housing 10, other than the watertight resin portion 112*c*, does not melt, thus preventing deviation of the contacts 20 relative to the housing 10.

Therefore, according to this embodiment, since a portion between the housing 10 for holding the contacts 20 and the constriction portion 42, which is provided in the rear of the diameter enlarging portion 41 so as to protrude the terminal portions 22*a* and the terminal portions 22*b* therefrom and has the smaller diameter than the front shell member 30 and the diameter enlarging portion 41, is tightly sealed, it is possible to downsize the electrical connector 1 on its rear side from which the terminal portions 22*a* and the terminal portions 22*b* of the contacts 20 protrude, as well as to provide a watertight function.

According to this embodiment, since the housing 10 for holding the contacts 20 is in close contact with the constriction portion 42 along the circumferential direction of the inner peripheral surface of the constriction portion 42 so as to tightly seal a gap between the housing 10 and the constriction portion 42, it is possible to provide a watertight function, without providing a watertight member separate from the housing 10 between the contacts 20 and the constriction portion 42.

According to this embodiment, since the housing 10 has the silane coupling agent at a portion being in close contact with the constriction portion 42, the housing 10 for holding the contacts 20 can seal a gap between the constriction portion 42 and the housing 10.

According to this embodiment, since the other component 300 can be disposed in the vicinity of the constriction portion 42, it is possible to provide the electrical connector 1 that can contribute to slimming and downsizing of the device.

Second Embodiment

<Configuration of Electrical Connector>

The configuration of an electrical connector 2 according to a second embodiment of the present invention will be described below in detail with reference to FIG. 7.

Figure 7:
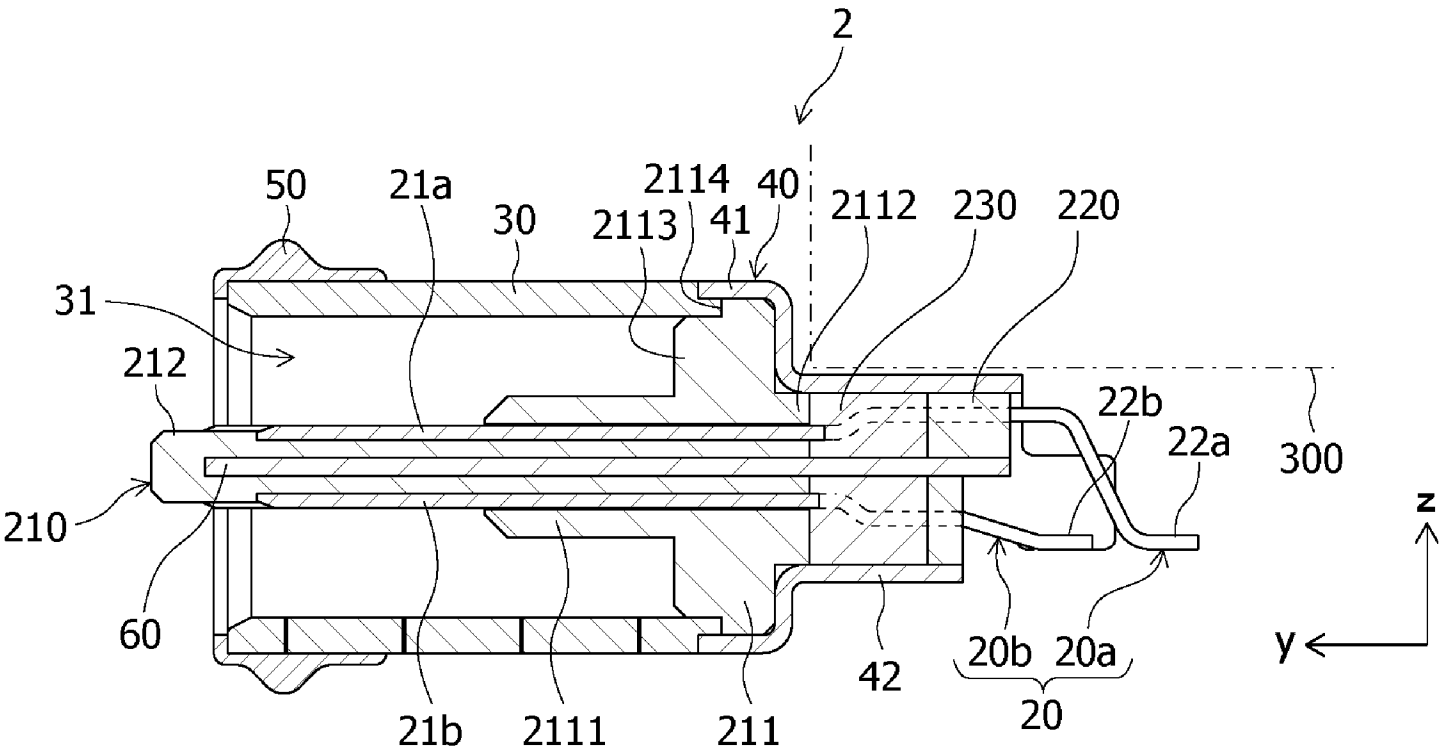
FIG. 7 is a cross-sectional view of an electrical connector according to a second embodiment of the present invention.

Note that, in FIG. 7, the same reference numerals as in FIGS. 1 to 6 indicate the same components, and a description thereof will be omitted.

The electrical connector 2 according to this embodiment includes contacts 20, a front shell member 30, a rear shell member 40, an external watertight member 50, a shielding plate 60, a first housing 210, a second housing 220, and an internal watertight member 230.

The first housing 210, which is made of an insulating material, holds the contacts 20. The first housing 210 has a main body portion 211 and a plate-like portion 212.

The main body portion 211 for holding the contacts 20 includes a front protruding portion 2111 protruding frontward, a rear protruding portion 2112 protruding rearward, and an outward protruding portion 2113 protruding outward relative to the front protruding portion 2111 and the rear protruding portion 2112 between the front protruding portion 2111 and the rear protruding portion 2112. The outward protruding portion 2113 has a step portion 2114.

The plate-shaped plate-like portion 212 protrudes frontward relative to the main body portion 211, and protrudes frontward at its front end relative to the front shell member 30.

The second housing 220 holds the contacts 20 in the rear of the first housing 210.

The internal watertight member 230 is formed of an elastic material so as to be in close contact with an inner peripheral surface of the rear shell member 40 when being cured, specifically, a material having higher elasticity than the first housing 210 and the second housing 220 when being cured, such as a thermosetting resin (for example, silicone rubber) or a thermoplastic resin. The internal watertight member 230 is provided between the rear protruding portion 2112 of the first housing 210 and the second housing 220, and corresponds to a first member that is in close contact with the rear shell member 40 along a circumferential direction of the inner peripheral surface of the rear shell member 40. The internal watertight member 230 holds the contacts 20.

The first housing 210, the second housing 220, and the internal watertight member 230 correspond to a holding member for holding the contacts 20. The first housing 210 and the second housing 220 correspond to a second member having a lower elasticity than the internal watertight member 230.

The contacts 20 are made of a conductive material, and held by the first housing 210, the second housing 220, and the internal watertight member 230. The first housing 210, the second housing 220, and the internal watertight member 230 insulate first contacts 20*a* and second contacts 20*b* from each other.

Each first contact 20*a* includes a connection portion 21*a* that is exposed on the front side of the first housing 210 on a top surface of the plate-like portion 212 to connect to a mating contact of a not-shown mating connector, and a terminal portion 22*a* that protrudes rearward relative to the second housing 220 and is soldered to a conductive portion of a not-shown substrate. The first contact 20*a* is embedded in the front protruding portion 2111, the rear protruding portion 2112, and the outward protruding portion 2113 at a portion between the connection portion 21*a* and the terminal portion 22*a*. The first contact 20*a* is in close contact with the internal watertight member 230 along its outer peripheral surface. The first contact 20*a* is bent in the left, right, and upward directions in shape at a portion being in close contact with the internal watertight member 230.

Each second contact 20*b* includes a connection portion 21*b* that is exposed on the front side of the first housing 210 on a bottom surface of the plate-like portion 212 to connect to the mating contact of the not-shown mating connector, and a terminal portion 22*b* that protrudes rearward relative to the second housing 220 and is soldered to the not-shown substrate. The second contact 20*b* is embedded in the front protruding portion 2111, the rear protruding portion 2112, and the outward protruding portion 2113 at a portion between the connection portion 21*b* and the terminal portion 22*b*. The second contact 20*b* is in close contact with the internal watertight member 230 along its outer peripheral surface. The second contact 20*b* is bent in the left, right, and downward directions in shape at a portion being in close contact with the internal watertight member 230.

The plate-like portion 212 and the front protruding portion 2111 are disposed in a fitting portion 31. The front shell member 30 is in contact with the step portion 2114 at its rear end, and is held on the front side of the outward protruding portion 2113.

The rear shell member 40 includes a diameter enlarging portion 41 held on the rear side of the outward protruding portion 2113, and a constriction portion 42 that is continuously formed in the rear of the diameter enlarging portion 41 and has a smaller diameter than the diameter enlarging portion 41, so that the rear shell member 40 is narrowed rearward in shape. The constriction portion 42 is in close contact with the internal watertight member 230 along an inner peripheral surface.

The shielding plate 60 is embedded in the first housing 210, the second housing 220, and the internal watertight member 230.

When the electrical connector 2 having the above-described configuration is attached to a casing of a not-shown electronic device, as shown in FIG. 7, another component 300 such as an LCD can be disposed above the constriction portion 42, as well as below or to the side of the constriction portion 42, because the constriction portion 42 has the smaller outer diameter than the front shell member 30 and the diameter enlarging portion 41.

<Method for Manufacturing Electrical Connector>

A method for manufacturing the electrical connector 2 according to the second embodiment of the present invention will be described below in detail.

First, the contacts 20 and the shielding plate 60 formed in advance are set in a not-shown mold, and a molten resin is injected into and cured in the mold, to form a primary molded article by integral molding. The primary molded article has the contacts 20, the shielding plate 60, the first housing 210, and the second housing 220.

In the primary molded article, a space is formed between the rear protruding portion 2112 of the first housing 210 and the second housing 220, and the rear protruding portion 2112 and the second housing 220 are opposed to each other. In the space between the rear protruding portion 2112 and the second housing 220, part of the first contacts 20*a* and part of the second contacts 20*b* are exposed to outside.

Next, the primary molded article formed as described above is set in a not-shown mold, and a molten material that has a higher elasticity than the first housing 210 and the second housing 220 when being cured is injected into and cured in the space between the rear protruding portion 2112 and the second housing 220, to form a secondary molded article. The secondary molded article has the primary molded article and the internal watertight member 230. In other words, in the secondary molded article, the internal watertight member 230 is added to the primary molded article. The outer diameter of the internal watertight member 230 of the secondary molded article is slightly larger than the inner diameter of the constriction portion 42 of a rear shell member 40.

Next, the secondary molded article formed as described above is covered with the front shell member 30 from the front, and is covered with the rear shell member 40 from the rear. At this time, since the outer diameter of the internal watertight member 230 is slightly larger than the inner diameter of the constriction portion 42 of the rear shell member 40, the internal watertight member 230 can be press-fitted into the constriction portion 42. Thus, the internal watertight member 230 is in press contact with and in close contact with the constriction portion 42 along an inner peripheral surface of the constriction portion 42.

Next, the rear end of the front shell member 30 and the front end of the rear shell member 40 are welded to attach the front shell member 30 and the rear shell member 40 onto the secondary molded article.

Next, the external watertight member 50 is attached to the front end of the front shell member 30.

In the electrical connector 2 manufactured by the above-described method, since the internal watertight member 230 is in close contact with the inner peripheral surface of the rear shell member 40 so as to seal a gap between the internal watertight member 230 and the rear shell member 40, the interior of the electronic device to which the electrical connector 2 is attached can be made watertight. In the electrical connector 2, since the internal watertight member 230 is in close contact with the outer peripheral surfaces of the contacts 20 so as to seal a gap between the internal watertight member 230 and each contact 20, a gap between the first housing 210 and each contact 20 is tightly sealed, and the interior of the electronic device to which the electrical connector 2 is attached can be made watertight. Furthermore, only providing the internal watertight member 230 between the contacts 20 and the constriction portion 42 enables the electrical connector 2 to have a watertight function. Thus the electrical connector 2 on its rear side can be downsized.

Therefore, according to this embodiment, since a portion between the internal watertight member 230 for holding the contacts 20 and the constriction portion 42, which is provided in the rear of the diameter enlarging portion 41 so as to protrude the terminal portions 22*a* and the terminal portions 22*b* therefrom and has the smaller diameter than the front shell member 30 and the diameter enlarging portion 41, is tightly sealed, it is possible to downsize the electrical connector 2 on its rear side from which the terminal portions 22*a* and the terminal portions 22*b* of the contacts 20 protrude, as well as to provide a watertight function.

According to this embodiment, since the internal watertight member 230 for holding the contacts 20 is in close contact with the constriction portion 42 along the circumferential direction of the inner peripheral surface of the constriction portion 42 so as to tightly seal a gap between the internal watertight member 230 and the constriction portion 42, it is possible to provide a watertight function, without providing a watertight member separate from the internal watertight member 230 between the contacts 20 and the constriction portion 42.

According to this embodiment, since the internal watertight member 230 having the higher elasticity than the first housing 210 and the second housing 220 is in close contact with the constriction portion 42, the internal watertight member 230 for holding the contacts 20 can seal a gap between the constriction portion 42 and the internal watertight member 230.

According to this embodiment, since the other component 300 can be disposed in the vicinity of the constriction portion 42, it is possible to provide the electrical connector 2 that can contribute to slimming and downsizing of the device.

Third Embodiment

The configuration of an electrical connector 3 according to a third embodiment of the present invention will be described below in detail with reference to FIG. 8.

Figure 8:
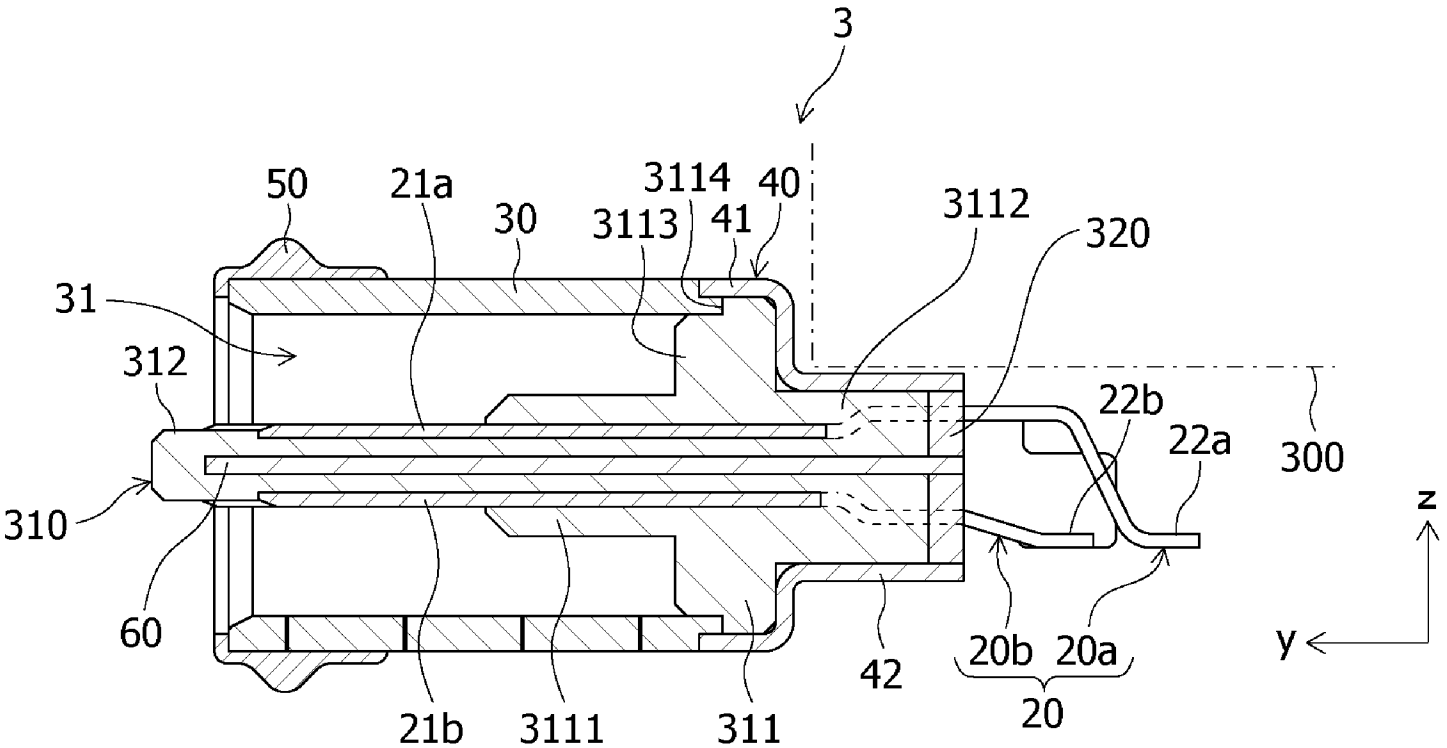
FIG. 8 is a cross-sectional view of an electrical connector according to a third embodiment of the present invention.

Note that, in FIG. 8, the same reference numerals as in FIGS. 1 to 6 indicate the same components, and a description thereof will be omitted.

The electrical connector 3 according to this embodiment includes contacts 20, a front shell member 30, a rear shell member 40, an external watertight member 50, a shielding plate 60, a housing 310, and a potting member 320.

The housing 310, which is made of an insulating material, is a holding member for holding the contacts 20. The housing 310 has a main body portion 311 and a plate-like portion 312.

As shown in FIG. 8, the main body portion 311 for holding the contacts 20 includes a front protruding portion 3111 protruding frontward, a rear protruding portion 3112 protruding rearward, and an outward protruding portion 3113 protruding outward relative to the front protruding portion 3111 and the rear protruding portion 3112 between the front protruding portion 3111 and the rear protruding portion 3112. The outward protruding portion 3113 has a step portion 3114.

The plate-shaped plate-like portion 312 protrudes frontward relative to the main body portion 311, and protrudes frontward at its front end relative to the front shell member 30.

The contacts 20 are made of a conductive material, and held by the housing 310. The housing 310 insulates first contacts 20*a* and second contacts 20*b* from each other.

Each first contact 20*a* includes a connection portion 21*a* that is exposed on the front side of the housing 310 on a top surface of the plate-like portion 312 to connect to a mating contact of a not-shown mating connector, and a terminal portion 22*a* that protrudes rearward relative to the housing 310 and is soldered to a conductive portion of a not-shown substrate. The first contact 20*a* is embedded in the front protruding portion 3111, the rear protruding portion 3112, and the outward protruding portion 3113 at a portion between the connection portion 21*a* and the terminal portion 22*a*. The first contact 20*a* is in close contact with the potting member 320 along its outer peripheral surface.

Each second contact 20*b* includes a connection portion 21*b* that is exposed on the front side of the housing 310 on a bottom surface of the plate-like portion 312 to connect to the mating contact of the not-shown mating connector, and a terminal portion 22*b* that protrudes rearward relative to the housing 310 and is soldered to the not-shown substrate. The second contact 20*b* is embedded in the front protruding portion 3111, the rear protruding portion 3112, and the outward protruding portion 3113 at a portion between the connection portion 21*b* and the terminal portion 22*b*. The second contact 20*b* is in close contact with the potting member 320 along its outer peripheral surface.

The plate-like portion 312 and the front protruding portion 3111 are disposed in a fitting portion 31. The front shell member 30 is in contact with the step portion 3114 at its rear end, and is held on the front side of the outward protruding portion 3113.

The rear shell member 40 includes a diameter enlarging portion 41 held on the rear side of the outward protruding portion 3113, and a constriction portion 42 that is continuously formed in the rear of the diameter enlarging portion 41 and has a smaller diameter than the diameter enlarging portion 41, so that the rear shell member 40 is narrowed rearward in shape. The constriction portion 42 is in close contact with the potting member 320 along a circumferential direction of an inner peripheral surface.

The shielding plate 60 is embedded in the housing 310.

The potting member 320 is provided in the rear of the housing 310, so as to be in close contact with the inner peripheral surface of the constriction portion 42 along the circumferential direction of the inner peripheral surface of the constriction portion 42 and so as to be in close contact with a rear surface of the housing 310. The potting member 320 is a sealing member, such as an adhesive, for tightly sealing a gap between the housing 310 and the constriction portion 42. The potting member 320 is in close contact with an outer peripheral surface of each contact 20 to seal a gap between the potting member 320 and each contact 20.

When the electrical connector 3 having the above-described configuration is attached to a casing of a not-shown electronic device, as shown in FIG. 8, another component 300 such as an LCD can be disposed above the constriction portion 42, as well as below or to the side of the constriction portion 42, because the constriction portion 42 has a smaller outer diameter than the front shell member 30 and the diameter enlarging portion 41.

<Method for Manufacturing Electrical Connector>

A method for manufacturing the electrical connector 3 according to the third embodiment of the present invention will be described below in detail.

First, the contacts 20 and the shielding plate 60 formed in advance are set in a not-shown mold, and a molten resin is injected into and cured in the mold, to form a molded article into which the housing 310, the contacts 20, and the shielding plate 60 are integrated by integral molding.

Next, the molded article formed as described above is covered with the front shell member 30 from the front, and is covered with the rear shell member 40 from the rear.

Next, the rear end of the front shell member 30 and the front end of the rear shell member 40 are welded to attach the front shell member 30 and the rear shell member 40 onto the molded article.

Next, the external watertight member 50 is attached to the front end of the front shell member 30.

Next, in the rear of the housing 310, the potting member 320 is applied to the constriction portion 42 along the rear surface of the housing 310 and the circumferential direction of the inner peripheral surface of the constriction portion 42, followed by drying.

In the electrical connector 3 manufactured by the above-described method, since the potting member 320 is in close contact with the rear surface of the housing 310 and the inner peripheral surface of the rear shell member 40 so as to seal a gap between the housing 310 and the rear shell member 40, the interior of the electronic device to which the electrical connector 3 is attached can be made watertight. In the electrical connector 3, since the potting member 320 is in close contact with the outer peripheral surfaces of the contacts 20 so as to seal a gap between the internal watertight member 230 and each contact 20, a gap between the housing 310 and each contact 20 is tightly sealed, and the interior of the electronic device to which the electrical connector 3 is attached can be made watertight. Furthermore, since only the housing 310 or the potting member 320 is provided between the contacts 20 and the constriction portion 42 in the electrical connector 3, it is possible to downsize the electrical connector 3 on its rear side.

Therefore, according to this embodiment, since a portion between the housing 310 for holding the contacts 20 and the constriction portion 42, which is provided in the rear of the diameter enlarging portion 41 so as to protrude the terminal portions 22*a* and the terminal portions 22*b* therefrom and has the smaller diameter than the front shell member 30 and the diameter enlarging portion 41, is tightly sealed, it is possible to downsize the electrical connector 3 on its rear side from which the terminal portions 22*a* and the terminal portions 22*b* of the contacts 20 protrude, as well as to provide a watertight function.

According to this embodiment, since the potting member 320 provided in the rear of the housing 310 tightly seal a gap between the housing 310 and the constriction portion 42, it is possible to provide a watertight function, without providing a watertight member separate from the housing 310 between the contacts 20 and the constriction portion 42.

According to this embodiment, since the other component 300 can be disposed in the vicinity of the constriction portion 42, it is possible to provide the electrical connector 3 that can contribute to slimming and downsizing of the device.

The present invention is not limited to the foregoing embodiments in terms of the types, arrangement, numbers, or the like of the members. It will be understood that appropriate modifications may be made without departing from the gist of the invention. For example, the components may be replaced with ones having similar operations and effects as appropriate.

To be more specific, in the above-described first to third embodiments, the two members, i.e., the front shell member 30 and the rear shell member 40 constitute one shell, but the shell may be constituted of a single member.

The embodiment of the present invention is suitably applied to electrical connectors having a watertight function.

REFERENCE SIGNS LIST

1 electrical connector
2 electrical connector
3 electrical connector
10 housing
11 main body portion
12 plate-like portion
20 contact
20*a* first contact
20*b* second contact
21*a* connection portion
21*b* connection portion
22*a* terminal portion
22*b* terminal portion
30 front shell member
31 fitting portion
40 rear shell member
41 diameter enlarging portion
42 constriction portion
50 external watertight member
60 shielding plate
100 primary molded article
111 front protruding portion
112 rear protruding portion
112*a* rear end portion
112*b* space
112*c* watertight resin portion
112*d* front end portion
113 outward protruding portion
114 step portion
150 secondary molded article
210 first housing
211 main body portion
212 plate-like portion
220 second housing
230 internal watertight member
300 component
310 housing
311 main body portion
312 plate-like portion
320 potting member
2111 front protruding portion
2112 rear protruding portion
2113 outward protruding portion
2114 step portion

3111 front protruding portion
3112 rear protruding portion
3113 outward protruding portion
3114 step portion

The invention claimed is:

1. An electrical connector comprising:

an insulating holding member;

a conductive contact held by the holding member, the conductive contact including a connection portion exposed on a front side of the holding member to connect to a mating contact of a mating connector and a terminal portion protruding from the holding member; and a cylindrical shell configured to contain the holding member, the cylindrical shell including a large diameter portion and a small diameter portion, the large diameter portion having a fitting portion open to a front into which the mating connector is insertable, the small diameter portion being provided in a rear of the large diameter portion so as to protrude the terminal portion therefrom, the small diameter portion having a smaller diameter than the large diameter portion, wherein a space between the holding member and the small diameter portion of the cylindrical shell is tightly sealed, and a diameter of the small diameter portion of the cylindrical shell is smaller than a diameter of the large diameter portion around an entire circumference of the cylindrical shell.

2. The electrical connector according to claim 1, wherein the holding member is in close contact with the small diameter portion of the cylindrical shell along a circumferential direction of an inner peripheral surface of the small diameter portion, so that the space between the holding member and the small diameter portion of the cylindrical shell is tightly sealed.

3. The electrical connector according to claim 2, wherein the holding member contains a silane coupling agent in a portion that is in close contact with the small diameter portion of the cylindrical shell.

4. The electrical connector according to claim 2, wherein the holding member includes a first member that is in close contact with the small diameter portion of the cylindrical shell and has elasticity, and a second member having smaller elasticity than that of the first member.

5. The electrical connector according to claim 1, comprising a sealing member provided in a rear of the holding member, the sealing member being configured to tightly seal the space between the holding member and the small diameter portion of the cylindrical shell.

* * * * *